US007491294B2

(12) United States Patent
Brouillette et al.

(10) Patent No.: US 7,491,294 B2
(45) Date of Patent: Feb. 17, 2009

(54) COMPOSITIONS FOR REDUCING PAPER LINTING AND DUSTING

(75) Inventors: François Brouillette, St-Jean-Chrysostome (CA); Daniel Morneau, Trois-Rivieres (CA); François Fournier, Saint-Augustin-de-Desmaures (CA)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 515 days.

(21) Appl. No.: 10/953,911

(22) Filed: Sep. 29, 2004

(65) Prior Publication Data

US 2005/0077022 A1 Apr. 14, 2005

Related U.S. Application Data

(60) Provisional application No. 60/509,262, filed on Oct. 8, 2003.

(51) Int. Cl.
*D21H 17/10* (2006.01)
*D21H 17/28* (2006.01)
*D21H 17/60* (2006.01)

(52) U.S. Cl. ..... 162/158; 162/161; 162/172; 162/175; 162/185; 558/70; 558/207

(58) Field of Classification Search ..... 162/158, 162/161, 172, 175, 185; 558/70, 207
See application file for complete search history.

(56) References Cited

U.S. PATENT DOCUMENTS

| | | | | | |
|---|---|---|---|---|---|
| 3,640,756 | A | | 2/1972 | Beersma et al. | 117/76 |
| 5,256,254 | A | * | 10/1993 | Pease et al. | 162/199 |
| 5,639,812 | A | * | 6/1997 | Takeda et al. | 524/272 |
| 5,830,318 | A | | 11/1998 | Snow et al. | 162/139 |
| 6,001,166 | A | * | 12/1999 | Ettl et al. | 106/287.2 |
| 6,093,217 | A | * | 7/2000 | Frolich et al. | 8/115.6 |
| 6,165,259 | A | * | 12/2000 | Hallstrom et al. | 106/243 |
| 6,165,320 | A | * | 12/2000 | Bates et al. | 162/135 |
| 6,398,912 | B1 | | 6/2002 | Vihervaara et al. | 162/175 |
| 6,565,646 | B1 | | 5/2003 | Lasmarias et al. | 106/801 |
| 2003/0041988 | A1 | | 3/2003 | Vihervaara et al. | 162/149 |
| 2003/0109617 | A1 | | 6/2003 | Niinikoski et al. | 524/425 |
| 2003/0152724 | A1 | | 8/2003 | Swoboda et al. | 428/34.2 |
| 2004/0206274 | A1 | * | 10/2004 | Kruckel | 106/164.4 |

FOREIGN PATENT DOCUMENTS

| | | |
|---|---|---|
| EP | 1229165 | 8/2002 |
| WO | 01/51706 | 7/2001 |

OTHER PUBLICATIONS

English language abstract for EP 1229165 (2002).

* cited by examiner

*Primary Examiner*—Eric Hug
*Assistant Examiner*—Dennis Cordray
(74) *Attorney, Agent, or Firm*—Joseph C. Suhadolnik

(57) ABSTRACT

The present invention relates to a new paper making composition useful for reducing linting and dusting in paper, a method for reducing paper linting and dusting wherein certain phosphate esters are added to a fiber pulp during the paper making process and the novel additive composition for reducing linting and dusting in paper comprising the phosphate ester.

11 Claims, No Drawings

COMPOSITIONS FOR REDUCING PAPER LINTING AND DUSTING

This application claims the benefit under 35 USC 119(e) of U.S. Provisional Application No. 60/509,262 filed on Oct. 8, 2003.

The present invention relates to a new paper making composition useful for reducing Tinting and dusting in paper, a method for reducing paper Tinting and dusting wherein certain phosphate esters are added to a fiber pulp during the paper making process and the novel additive composition employed.

BACKGROUND OF THE INVENTION

Linting and dusting concern any release of fibers at the paper surface. It gives rise to problems at the drying stage in paper making and in machines and equipment used for handling paper such as printing equipment. For example, fibers removed from paper surfaces during printing cause the accumulation of fibers on press parts such as blankets, plates, and rollers. Linting and dusting may become a nightmare for some printers: fibers interfere with the ink transfer and stopping the press to wash the blanket is costly.

To reduce Tinting and dusting, mechanical methods and chemical additives are normally used. For example, a Teflon® coating on the dryer cylinders significantly reduces the deposition of fibers thereon, however, it also reduces heat transfer, as Teflon® is an insulating material. Moreover, it is sensitive to scratches and quickly deteriorates. During printing, increasing the water flow and reducing the press speed or the blanket also reduce dusting and linting, however, it also reduces the production level. In order to solve the tinting and dusting problems, U.S. Pat. No. 6,398,912 describes an additive made from starch while U.S. Pat. No. 6,565,646 describes an additive made from clay. Despite these known solutions, paper dusting and tinting remain a significant problem and there exists a need for a new additive for paper making.

SUMMARY OF THE INVENTION

It is an object of the present invention to provide a new composition for paper making that reduces paper dusting and linting.

It is also an object of the present invention to provide a new lint reducing composition for paper making comprising at least one phosphate ester which is formulated with the fiber pulp prior to web formation.

It is also an object of the present invention to provide a new lint reducing additive composition for paper making that will not affect the paper retention and drainage as well as the slide angle.

The above and other objects are achieved by providing a fiber pulp composition comprising a phosphate ester for use in paper making which reduces paper linting and dusting The additive composition according to the present invention comprises the said phosphate ester which is added to the fiber pulp prior to web formation to reduce paper tinting and dusting. The phosphate ester component of the present invention can also be called an organic ester of phosphoric acid or alcohol phosphate and may be neutralized with an amine or a base derived from the alkali or alkaline earth. Such phosphate esters or neutralized phosphate esters are commercially available for use as surfactants and other uses.

Another aspect of the present invention includes a method to reduce paper linting and dusting which method comprises adding the phosphate esters or neutralized phosphate esters of the present invention to a fiber pulp prior to web formation.

An alternate method to reduce paper linting and dusting is also provided, which method comprises adding a formulation containing the phosphate esters of the present invention, i.e. the additive composition of the present invention, to a fiber pulp prior to web formation.

DETAILED DESCRIPTION OF THE INVENTION

According to the present invention, to reduce paper dusting and linting, a composition comprising at least one phosphate ester and fiber pulp is prepared prior to web formation. The phosphate ester is a surface active agent which holds the paper fibers together. It has the general formula

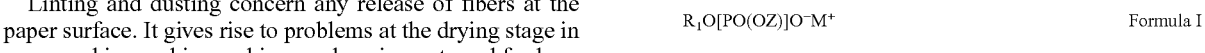

$$R_1O[PO(OZ)]O^-M^+ \qquad \text{Formula I}$$

or

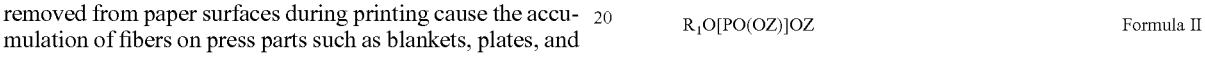

$$R_1O[PO(OZ)]OZ \qquad \text{Formula II}$$

wherein $R_1$ is an alkyl chain of 2-24 carbon atoms, or said alkyl chain interrupted by one or more groups >NR2 or —O— or said alkyl or interrupted alkyl is substituted by one or more groups —$NR_2R_3$ or OH wherein $R_2$ and $R_3$ are independently H, alkyl chain of 1-8 carbon atoms or an alkyl chain of 2-6 carbon atoms substituted by one or more —OH groups, Z is independently H or an alkyl chain of 1-24 carbon atoms, or said alkyl chain interrupted by one or more groups >NR2 or —O— or said alkyl or interrupted alkyl is substituted by one or more groups —$NR_2R_3$ or —OH wherein $R_2$ and $R_3$ are independently H, alkyl chain of 1-8 carbon atoms or an alkyl chain of 2-6 carbon atoms substituted by one or more —OH groups, or $R_1$ and one of group Z are linked by a group G,

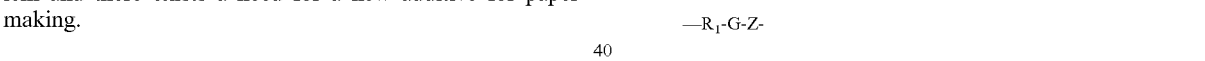

$$—R_1\text{-}G\text{-}Z\text{-}$$

forming together with the adjoining oxygen and phosphorous atoms a 5 to 12 membered heterocyclic ring containing 2 to 8 carbon atoms wherein G is a direct bond, an oxygen atom or N—$R_2$, where $R_2$ is as described above, and $M^+$ is H, an amino cation, or a metal cation selected from the group of alkaline and alkaline earth metals.

The phosphate ester is, for example, a compound where $R_1$ is an alkyl chain of 4-18 carbon atoms, Z is independently H or an alkyl chain of 1-18 carbon atoms, or said alkyl chain interrupted by one or more groups >NR2 or —O— or said alkyl or interrupted alkyl is substituted by one or more groups —$NR_2R_3$ or —OH wherein $R_2$ and $R_3$ are independently H, alkyl chain of 1-8 carbon atoms or an alkyl chain of 2-6 carbon atoms substituted by one or more —OH groups, and $M^+$ is H, an amino cation, or a metal cation selected from the group of alkaline and alkaline earth metals.

For example, $R_1$ is an alkyl chain of 4-18 carbon atoms,

Z is independently H or an alkyl chain of 4-18 carbon atoms, and $M^+$ is H, an alkyl chain of 4-18 carbon atoms, or an amino cation.

For example, $R_1$ is an alkyl chain of 4-18 carbon atoms,

Z is independently H or an alkyl chain of 4-18 carbon atoms, and $M^+$ is H, or an amino cation.

When $R_1$ and Z are linked by a group G, the heterocycle is, for example a compound of the formula

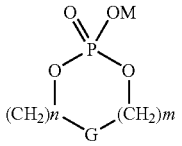

where n and m are independently from 1-4 and represent to number of methylene groups designated and G is a direct bond or selected from the group —NH—, —N $R_2$,- or —O—, where $R_2$ is as described above, and M is H or an ammonium cation.

For example, n and m are both 2 or 3, G is —NY— where Y is H, hydroxyethyl or hydroxypropyl, and M is H or ammonium cation.

An alkyl chain is straight or branched chain of the specified number of carbon atoms and is for example methyl, ethyl, n-propyl, n-butyl, sec-butyl, tert-butyl, n-hexyl, n-octyl, 2-ethylhexyl, n-nonyl, n-decyl, n-undecyl, n-dodecyl, n-tridecyl, n-tetradecyl, n-hexadecyl or n-octadecyl.

Examples of nitrogen cations are:

unsubstituted ammonium, mono-, di-, or tri-$C_{1-4}$alkylammonium, 3-propylammonium, isopropylammonium, butylammonium, sec-butylammonium, isobutylammonium, 1,2-dimethylpropylammonium, dimethylammonium, diethylammonium, dipropylammonium, diisopropylammonium, dibutylammonium, diisobutylammonium, di-sec-butylammonium, N-methyl-N-butylammonium or N-ethyl-N-butylammonium, trimethylammonium, triethylammonium, tripropylammonium, tributylammonium, N,N-dimethylethylammonium, N,N-dimethylisopropylammonium, $C_{1-4}$alkoxy-$C_{1-4}$alkylammonium, such as 2-methoxyethylammonium, bis(2-methoxyethyl)ammonium, 3-methoxypropylammonium or ethoxypropylammonium, mono-, di- or tri-(hydroxy-$C_{1-4}$alkyl)ammonium, such as mono-, di- or tri-ethanolammonium, mono-, di- or tri-propanolammonium, mono-, di- or tri-isopropanolammonium, N-methyl- or N,N-dimethyl-ethanolammonium, -propanolammonium or -isopropanolammonium, N-methyl-diethanolammonium, -dipropanolammonium or -diisopropanolammonium, N-ethyl-diethanolammonium, -dipropanolammonium or -diisopropanolammonium, N-propyl-diethanolammonium, -dipropanolammonium or -diisopropanolammonium.

For example the nitrogen cation is unsubstituted ammonium, diethanolammonium, triethanolammonium, dipropanolammonium, tripropanolammonium, diisopropanolammonium or triisopropanolammonium.

The phosphate ester, or mixture of phosphate esters, is present in the composition of the present invention in an amount between about 0.01 to about 5 kilograms per ton of paper produced. For example, the phosphate ester is present in an amount of between about 0.01 to about 2 kilograms per ton of paper produced. For example, the phosphate ester is present in an amount of between about 0.01 to about 1 kilograms per ton of paper produced. The term "ton of paper produced" refers to a metric ton of paper ultimately produced from the fiber pulp composition upon completing the steps a standard paper making process.

The phosphate ester can also be neutralized with an amine or a base derived from the alkali or alkaline earth metals metals forming an ammonium or metal cation. For example the phosphate ester can be neutralized with diethanolamine, triethanolamine, dipropanolamine or tripropanolamine. An excess of amine, alkali or alkaline earth base may be used.

The composition of the present invention can also comprise wax particles. Wax also reduces paper dusting and linting but to a lower extent than phosphate ester. Wax particles can originate from mineral wax, either slack wax or refined paraffin, or polyethylene synthetic wax. When present, the wax is present in a weight: weight ratio of wax to phosphate ester of from 0.1:1 to 9:1. For example, the wax is present in a weight:weight ratio of wax to phosphate ester of from 1:1 to 6:1. For example, the wax is present in a weight:weight ratio of wax to phosphate ester in a ratio of from 2:1 to 5:1. When the composition contains wax particles, the wax is homogenized with the phosphate ester and other suitable formulation materials in an appropriate apparatus before being added to the fiber pulp. Homogenization is performed until the wax particle size is under 100 μm to obtain an emulsion. Particle size is important to stabilize the emulsion and to have a good dispersion of the active linting and dusting reducing agents in the fiber pulp.

The composition of the present invention can also comprise starch. For example, the starch is selected from the group consisting of potato starch, tapioca starch and corn starch. When present, the starch is present in a weight:weight ratio of starch to phosphate ester of from 0.1:1 to 9:1. For example, the starch is present in a weight: weight ratio of starch to phosphate ester of from 1:1 to 6:1. For example, the starch is present in a weight: weight ratio of starch to phosphate ester of from 1:1 to 3:1. It can consist of potato, tapioca, or corn starches. The starch added to the additive can be cationic to facilitate the adhesion of the additive to the pulp fibers since the latter are anionic.

The composition can also comprise a lignosulfate. When present, the lignosulfate is present in a weight: weight ratio of lignosulfate to phosphate ester of from 0.1:1 to 6:1. For example, the lignosulfate is present in a weight: weight ratio of lignosulfate to phosphate ester of from 1:1 to 3:1. It can consist of an ammonium or a sodium lignosulfate. The lignosulfate maintains the emulsion stability and provides a good dispersion of the additive in the fiber pulp.

Other elements common to paper making can also be added to the phosphate ester and fiber pulp composition of the present invention. For example the composition may also comprise a small quantity of biocides in the emulsion commonly employed to prevent mold formation.

Finally, the composition, with or without starch, can be cationic, neutral or anionic. The phosphate ester and other elements of the present composition are added to the fiber pulp prior to web formation.

The present invention also provides an additive composition useful in reducing paper linting and dusting in paper making which composition comprises 1) about 5 to about 50% weight percent phosphate ester described above,
2) about 40 to about 95% water,
3) about 0 to about 50% wax,
4) about 0 to about 50% starch,
5) about 0 to about 30% lignosulfate,
6) about 0 to about 3% biocide.

where the percentages refer to the weight percent of the material in the final formulation.

For example the additive composition comprises 1) about 5 to about 50% phosphate ester described above,
2) about 40 to about 90% water, 3) about 5 to about 30% wax,
4) about 0 to about 50% starch,
5) about 0 to about 30% lignosulfate,
6) about 0 to 3% biocide.

For example the additive composition comprises 1) about 5 to about 50% phosphate ester described above,
2) about 40 to about 90% water,
3) about 0 to about 50% wax,
4) about 5 to about 50% starch,
5) about 0 to about 30% lignosulfate,
6) about 0.01 to about 3% biocide.

For example the additive composition comprises 1) about 5 to about 50% phosphate ester described above,
2) about 40 to about 90% water,
3) about 0 to about 50% wax,
4) about 0 to about 50% starch,
5) about 5 to about 30% lignosulfate,
6) about 0 to about 3% biocide.

The additive composition can be neutralized with an amine or a base derived from the alkali or alkaline earth metals. For example the additive can be composition neutralized with diethanolamine, triethanolamine, dipropanolamine or tripropanolamine. An excess of amine, alkali or alkaline earth base may be used.

When the additive composition contains wax particles, the wax is homogenized with the phosphate ester and other suitable formulation materials in an appropriate apparatus before being added to the fiber pulp. Homogenization is performed until the wax particle size is under 100 μm to obtain an emulsion. Particle size is important to stabilize the emulsion and to have a good dispersion of the active linting and dusting reducing agents in the fiber pulp.

The additive composition can be cationic, neutral or anionic; preferably cationic to facilitate adhesion of the additive to the pulp fibers.

The additive composition is added to the fiber pulp prior to web formation at an amount of about 0.05 to 5 kg per ton of paper produced. For example the additive is added at a dosing of 0.2 to 1 kg per ton of paper produced.

The present invention also provides a method for reducing linting and dusting in paper making which method comprises the step of preparing the composition comprising fiber pulp and phosphate ester or neutralized phosphate ester described above prior to web formation wherein the phosphate ester is added in an amount of about 0.01 to 5 kilograms per ton of paper produced. For example, the phosphate ester is added in an amount of between about 0.01 to 2 kilograms. For example, the phosphate ester is added in an amount of between about 0.01 to 1 kilograms per ton of paper produced. Other elements of the above composition may also be added.

The method for reducing linting and dusting in paper making may also be carried out by adding the phosphate ester element as a preformed additive composition comprising the phosphate ester as described in the present invention to the fiber pulp prior to web formation. The additive composition is added to the fiber pulp prior to web formation at an amount of about 0.05 to 5 kg per ton of paper produced. For example the additive is added at a dosing of 0.2 to 1 kg per ton of paper produced.

EXAMPLES

The Invention will now be illustrated by means of the following non-limiting examples. All percentages in the following examples are weight percentages based on the total weight of the mixture being produced in the process being described. All ratios, percentages and dose levels within the present specification should be understood to carry the preceding modifier 'about' or 'approximately' to compensate for concentrations just outside of the listed range.

The phosphate esters of the following examples are mixtures of the esters derived from phosphoric acid and commonly available mixtures of alkyl alcohols, predominately $C_8$ and $C_{10}$ alkyl alcohols of the formulae III, IV and V, where x, y and z range from 2 to 16 representing the number of methylene units present, and compounds of formula III and IV together constitute more than 90% of the ester mixture.

III

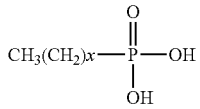

IV

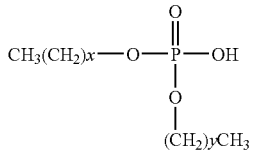

V

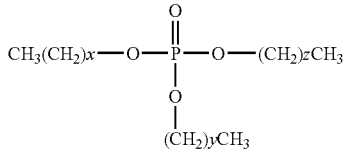

The term 'neutralized phosphate ester' in the following examples refers to the mixture resulting from neutralizing mixture of the phosphate esters above with diethanolamine.

Example 1

In a laboratory, the performance of the phosphate ester containing composition according to the present invention are compared to the performance of fiber pulp compositions containing commercial additives commonly employed to reduce Tinting and dusting.

Several fiber pulp compositions are prepared prior to web formation with various compositions, concentrations, and dosings of the neutralized phosphate ester described above and commercial linting reducing agents. The commercial additives are added at 1 kg per ton of paper produced, the neutralized phosphate ester is added in about half the concentration of the commercial active materials. Paper sheets are prepared and the percentage of fibers released is measured with a protective tape (5126C from 3M™) and a Kaptra metering device for linting. Results obtained are given in the table.

| Formulation, Fiber Pulp Plus: | % Fibers Released |
|---|---|
| Neutralized phosphate ester | 11.8 |
| Commercial cationic wax emulsion A | 11.8 |
| Commercial cationic wax emulsion B | 11.2 |
| Commercial cationic starch based additive | 15.0 |

Referring to the results, it will be seen that a similar performance is obtained with the neutralized phosphate ester with a half of the dosing.

Example 2

In a laboratory, several fiber pulp compositions are prepared prior to web formation with various compositions, concentrations, and dosings of linting reducing agents. The performance of the compositions according to the present invention is compared to the performance of compositions prepared using commercial additives. For each composition, hand sheets of 1.2 g are produced from mixtures of bleached mechanical, kraft and deinked pulps. The percentage of fibers released is measured on each handset with a protective tape (5126C from 3M™) and a Kaptra metering device for linting. Four samples of the present invention were tested.

The first sample is prepared by adding a mixture A of 10% neutralized phosphate ester, 30% of cationic corn starch and 60% of water to the fiber pulp prior to web formation in a dosing of 1 kg of mixture A per ton of paper produced.

The second sample is prepared by adding a mixture B of 10% neutralized phosphate ester, 40% of slack wax and 50% of water to the fiber pulp prior to web formation in a dosing of 1 kg of mixture B per ton of paper produced.

The third sample is prepared by adding a mixture C of 20% neutralized phosphate ester, 24% of slack wax and 56% of water to the fiber pulp prior to web formation in a dosing of 1 kg of mixture C per ton of paper produced.

The fourth sample is prepared by adding a mixture D of 20% neutralized phosphate ester, 24% of slack wax, 6% of lignosulfate and 50% of water to the fiber pulp prior to web formation in a dosing of 0.75 kg of mixture D per ton of paper produced.

A comparative sample is prepared by adding a commercial cationic starch based additive to the fiber pulp prior to web formation in a dosing of 1 kg of additive per ton of paper produced.

| Formulation | % Fibers Released |
|---|---|
| 1 | 18 |
| 2 | 16 |
| 3 | 13 |
| 4 | 15 |
| Commercial Comparison | 19 |

It is seen from the data that a better performance is obtained with the compositions of the present invention than with compositions containing the commercial additive. The best performance, i.e. the lowest percentage of fibers released, is obtained with the highest concentration of phosphate ester in the composition.

Example 3

Tests are made in the laboratory to measure the paper retention and drainage and the slide angle for several dosings of the phosphate esters of the present invention added to fiber pulp. Table 1 gives a summary of the results obtained for paper retention and drainage with and without neutralized phosphate ester.

A mixture E containing 10% of neutralized phosphate ester, 30% of slack wax, and 60% of water is prepared.

The sample of Test A contains no additive, to the sample of Test B is added mixture E in a dosing of 0.25 kg per ton of paper produced, to the sample of Test C is added mixture E in a dosing of 0.5 kg per ton of paper produced and to the sample of Test D is added mixture E in a dosing of 0.75 kg per ton of paper produced. To each sample also contains three products which are components of the actual retention test of the plant papermachine: 500 gr per ton of paper produced a cationic polymer emulsion, 300 gr per ton of paper produced of an adjuvant that improves PEO performance and 50 gr per ton of paper produced of a non-ionic polymer to improve retention and drainage (polyethylene oxide, PEO). These parameters are kept constant during the four tests. As seen by the data, the drainage time is reduced with the addition of the additive of the present invention while the retention is kept constant.

| Test | Vacuum Drainage (s) | Retention (%) |
|---|---|---|
| A | 32.5 | 96.27 |
| B | 19 | 96.36 |
| C | 24.5 | 96.24 |
| D | 22.5 | 96.27 |

Coefficient of friction tests were done with the standardized method Tappi T 815. Similar slide angles are obtained without additive, with a commercial cationic starch based and with the addition of mixture E, each at a dosing of 0.5 g per ton of paper produced.

| Pulp Fiber Composition | Slide Angle |
|---|---|
| No Additive | 31° |
| Commercial Cationic Starch at 5 g per ton of paper produced | 30° |
| Mixture E at 5 g per ton of paper produced | 34° |

Example 4

A test is carried out in a plant to measure the percentage of fibers released with and without the compositions of the present invention. Mixture E from Example 3 is added to the plant fiber pulp during standard plant operations in various dosings prior to web formation. The percentage of fibers released is measured as in Example 1. It is seen that the best performance is obtained with the highest dosing, i.e. 0.4 kg per ton of paper produced. Variations in the results obtained for the same dosage of a particular product are caused by water recirculation inside the plant. The water recirculated contains a remaining portion of the additive which affects the dosing.

| Hours | Dose of Mixture E (kg/ton of paper) | % Fibers Released |
|---|---|---|
| 0 | 0 | 2.3 |
| 2 | 0.08 | 1.8 |
| 5 | 0.2 | 1.1 |
| 10 | 0.2 | 1.3 |
| 12 | 0.2 | 1.3 |
| 15 | 0.2 | 1.8 |
| 20 | 0.33 | 1.0 |
| 24 | 0.33 | 1.1 |
| 25 | 0.40 | 0.5 |
| 28 | 0.40 | 0.6 |
| 30 | 0.33 | 1.1 |
| 35 | 0.33 | 1.0 |

Example 5

The method of reducing linting by adding a composition of the phosphate ester of the present invention is further demonstrated in the plant.

To mixture E from Example 3 is added 0.01% by weight of an isothiazoline biocide as a preservative to make Mixture F.

Rolls of paper are produced using standard plant operations. A commercial cationic wax containing linting reducer is added to the pulp fiber slurry prior to web formation at a rate of 100 mL per minute. Mixture F is likewise added to the fiber pulp slurry at the same rate. Mixture F is also added so as to create a fiber pulp composition comprising Mixture F at a concentration of 0.5 kg per ton of paper produced, that is 0.05 kg of neutralized phosphate ester per ton of paper produced.

After the trials with Mixture F, addition of the commercial cationic wax containing additive resumes.

Paper rolls are prepared and the percentage of fibers released is measured with a protective tape (5126C from 3M™) and a Kaptra metering device for linting.

| Additive | Dose | % Linting, top side (ave. of 3 measures) |
|---|---|---|
| Commercial Additive | 100 mL/min | 1.05 |
| Mixture F | 100 mL/min | 0.80 |
| Mixture F | 0.5 kg/ton of paper made | 0.55 |
| Commercial Additive | 100 mL/min | 1.05 |

Example 6

The method of reducing linting by adding a composition of the phosphate ester of the present invention is further demonstrated at different plant. The same commercial cationic wax containing additive is added to the pulp fiber slurry prior to web formation at a rate of 350 mL per minute. Mixture F is likewise added to the fiber pulp slurry at the same rate. Paper rolls are prepared and the percentage of fibers released is measured as in Example 5. An average of 3 readings is reported.

| Additive | % Linting wire side | % Linting felt side |
|---|---|---|
| Commercial cationic | 0.78 | 0.78 |
| Mixture F run 1 | 0.53 | 0.62 |
| Mixture F run 2 | 0.60 | 0.63 |
| Mixture F run 3 | 0.47 | 0.61 |

It is understood that the invention is not limited to the above preferred embodiments and that it covers any modifications thereto within the scope of the appended claims.

We claim:

1. A method to reduce paper linting and dusting, which method comprises adding to fiber pulp prior to web formation during paper making an amount of about 0.01 to about 5 kg per ton of paper produced an additive composition comprising a mixture of phosphate esters of formula II $$R_1O[PO(OZ)]OZ \qquad \text{II}$$

neutralized by an amine base wherein $R_1$ is an alkyl chain of 2-24 carbon atoms, Z is independently H or an alkyl chain of 1-24 carbon atoms, wherein the amine base is selected from the group consisting of diethanolamine, triethanolamine, diisopropanolamine and triisopropanolamine.

2. A method according to claim 1, wherein the additive composition comprises 1) about 5 to about 50% of the mixture of phosphate esters of formula II neutralized by adding an amine base
2) about 40 to about 95% water
3) about 0 to about 50% wax
4) about 0 to about 50% starch
5) about 0 to about 30% lignosulfate
6) about 0 to about 3% biocide where the percentages refer to the weight percent of the material in the final formulation.

3. A method according to claim 2, wherein the wax is selected from the group of mineral waxes, slack wax or refined paraffin wax and polyethylene synthetic waxes; the starch is selected from the group consisting of potato starch, tapioca starch and corn starch; the lignosulfate is selected from the group consisting of ammonium lignosulfates and sodium lignosulfates.

4. A method according to claim 3, wherein the additive composition comprises at least about 5% wax.

5. A method according to claim 3, wherein the additive composition comprises at least about 5% starch.

6. A method according to claim 5, wherein the starch is cationic.

7. A method according to claim 1, wherein the additive composition consists of 1) about 5 to about 50% of the mixture of phosphate esters of formula II neutralized by adding an amine base
2) about 40 to about 95% water
3) about 0 to about 50% wax
4) about 0 to about 50% starch
5) about 0 to about 30% lignosulfate
6) about 0 to about 3% biocide where the percentages refer to the weight percent of the material in the final formulation.

8. A method according to claim 7, wherein the wax is selected from the group of mineral waxes, slack wax or refined paraffin wax and polyethylene synthetic waxes; the starch is selected from the group consisting of potato starch, tapioca starch and corn starch; the lignosulfate is selected from the group consisting of ammonium lignosulfates and sodium lignosulfates.

9. A method according to claim 8, wherein the additive composition comprises at least about 5% starch.

10. A method according to claim 8, wherein the additive composition comprises at least about 5% starch.

11. A method according to claim 10, wherein the starch is cationic.

* * * * *